US010433610B2

(12) United States Patent
Lee

(10) Patent No.: US 10,433,610 B2
(45) Date of Patent: Oct. 8, 2019

(54) MECHANICAL-WAVES ATTENUATING PROTECTIVE HEADGEAR

(71) Applicant: Choon Kee Lee, Denver, CO (US)

(72) Inventor: Choon Kee Lee, Denver, CO (US)

( * ) Notice: Subject to any disclaimer, the term of this patent is extended or adjusted under 35 U.S.C. 154(b) by 129 days.

(21) Appl. No.: 15/815,475

(22) Filed: Nov. 16, 2017

(65) Prior Publication Data

US 2019/0142099 A1 May 16, 2019

(51) Int. Cl.

*A42B 3/00* (2006.01)
*A42B 3/06* (2006.01)
*A42B 3/12* (2006.01)

(52) U.S. Cl.

CPC ..... *A42B 3/063* (2013.01); *A42B 3/069* (2013.01); *A42B 3/128* (2013.01)

(58) Field of Classification Search

CPC ..... A42B 3/063; A42B 3/069; A42B 3/123
See application file for complete search history.

(56) References Cited

U.S. PATENT DOCUMENTS 4,213,202 A * 7/1980 Larry ..... A41D 31/285 2/456
4,375,108 A 3/1983 Gooding
4,484,364 A 11/1984 Mitchell et al.
4,564,959 A 1/1986 Zahn
4,566,137 A 1/1986 Gooding
4,985,931 A 1/1991 Wingo, Jr.
5,517,698 A * 5/1996 Nault ..... A42B 3/066 2/424
6,055,675 A * 5/2000 Egger ..... A42B 3/066 2/171.3
6,070,905 A * 6/2000 Renault ..... B60R 13/02 280/751
6,105,176 A * 8/2000 Egger ..... A42B 3/066 2/171.3
6,122,785 A * 9/2000 Bondie ..... A42B 3/121 5/655.3
6,317,896 B1 * 11/2001 Timms ..... A42B 3/08 2/411
6,446,270 B1 * 9/2002 Durr ..... A42B 3/061 2/412
6,658,671 B1 * 12/2003 Von Holst ..... A42B 3/064 2/412
6,839,910 B2 * 1/2005 Morrow ..... A63B 71/12 2/92
6,931,671 B2 * 8/2005 Skiba ..... A42B 3/063 2/410
7,802,320 B2 * 9/2010 Morgan ..... A42B 3/128 2/411
7,832,023 B2 11/2010 Crisco
(Continued)

*Primary Examiner* — Richale L Quinn

(57) ABSTRACT

The present invention provides a protective headgear having a multi-layered shell to attenuate amplitude of incident mechanical waves of a blunt trauma to a human head by inducing destructive interference with the incident mechanical waves through phase reversal of reflected mechanical waves reflecting off a boundary between two adjacent layers of the protective headgear, and by coaxially converging the phase-reversed reflected mechanical waves with the incident mechanical waves. The multi-layered shell is configured to equally protect people having a similar size of head but with a range of body weight.

14 Claims, 9 Drawing Sheets

(56) References Cited

U.S. PATENT DOCUMENTS 7,904,971 B2 * 3/2011 Doria ..... A42B 3/127 2/410
8,566,968 B2 * 10/2013 Marzec ..... A42B 3/12 2/411
8,615,817 B2 * 12/2013 Phillips ..... A42B 3/064 2/2.5
8,683,617 B2 * 4/2014 Chilson ..... A42B 3/32 2/171.1
8,756,719 B2 * 6/2014 Veazie ..... A42B 3/121 2/411
8,904,584 B2 * 12/2014 Sugano ..... A47C 27/00 5/652
8,955,169 B2 2/2015 Weber et al.
8,973,171 B2 * 3/2015 Cleva ..... A42B 1/08 2/181
9,131,743 B2 9/2015 Marzec et al.
9,220,311 B1 * 12/2015 Baldi ..... A42B 3/00
9,332,800 B2 * 5/2016 Brown ..... A42B 3/121
9,408,423 B2 * 8/2016 Guerra ..... A42B 3/064
2003/0139104 A1 * 7/2003 Arai ..... A42B 3/063 442/35
2003/0140400 A1 * 7/2003 Ho ..... A42B 3/063 2/411
2003/0180517 A1 * 9/2003 Karall ..... A43B 3/0026 428/304.4
2005/0196592 A1 * 9/2005 Tao ..... A42B 3/124 428/180
2006/0137073 A1 * 6/2006 Crisco ..... A42B 3/063 2/142
2006/0248630 A1 * 11/2006 Bullock ..... A42B 3/066 2/421
2008/0120764 A1 * 5/2008 Sajic ..... A42B 3/063 2/411
2009/0266663 A1 * 10/2009 Lin ..... A42B 3/063 188/372
2010/0000009 A1 * 1/2010 Morgan ..... A42B 3/124 2/414
2010/0299812 A1 * 12/2010 Maddux ..... A41D 13/0156 2/414
2011/0047678 A1 * 3/2011 Barth ..... A42B 3/124 2/411
2012/0060251 A1 * 3/2012 Schimpf ..... A42B 3/064 2/5
2012/0151664 A1 * 6/2012 Kirshon ..... A42B 3/121 2/413
2012/0198604 A1 * 8/2012 Weber ..... A42B 3/125 2/414
2013/0061375 A1 * 3/2013 Bologna ..... A42B 3/127 2/414
2013/0152287 A1 * 6/2013 Cormier ..... A42B 3/124 2/459
2013/0185837 A1 * 7/2013 Phipps ..... A42B 3/12 2/2.5
2014/0053323 A1 2/2014 Marzec et al.
2014/0208486 A1 * 7/2014 Krueger ..... A42B 3/064 2/414
2015/0157083 A1 * 6/2015 Lowe ..... A42B 3/128 2/412
2015/0264991 A1 * 9/2015 Frey ..... A42B 3/064 2/411
2015/0305427 A1 * 10/2015 Prabhu ..... A42B 3/128 2/412
2015/0320134 A1 * 11/2015 Stolker ..... A63B 71/10 2/411
2017/0280811 A1 * 10/2017 Finisdore ..... A42B 3/069
2017/0332719 A1 * 11/2017 Aaron ..... A42B 3/10
2018/0125141 A1 * 5/2018 Summerville ..... A42B 3/064
2019/0090576 A1 * 3/2019 Guinta ..... A42B 3/069
2019/0133233 A1 * 5/2019 Locatelli ..... A42B 3/063
2019/0142099 A1 * 5/2019 Lee ..... A42B 3/063

* cited by examiner

MECHANICAL-WAVES ATTENUATING PROTECTIVE HEADGEAR

TECHNICAL FIELD

The present invention relates generally to the field of protecting a human brain upon a trauma. More specifically, the present invention provides an apparatus to reduce amplitude of mechanical waves from the trauma to the human brain.

BACKGROUND OF THE INVENTION

Boundary effect of mechanical waves of a blunt trauma can be exploited for reducing amplitude of the mechanical waves delivered to a brain tissue, using a multi-layered protective shell to increase number of boundaries inside the protective shell of a protective headgear as practically many as possible to a point there would not be a serious tissue injury to the brain tissue. Separately in a model of a two-layer medium panel with a first layer adjoining a second layer without a gap, it is known that there is no phase change at a boundary between the first layer and the second layer having a lower hardness than that of the first layer in reflected mechanical waves from incident mechanical waves traveling from the first layer to the second layer. Combination of both the incident and reflected mechanical waves in phase with each other temporarily increases an amplitude of the incident mechanical waves which increases an amplitude of transmitted mechanical waves in the second layer from the incident mechanical waves. If a series of the incident mechanical waves impacts the first layer, an amplitude of the reflected mechanical waves off the boundary merges with an amplitude of successive mechanical waves following a first wave of the mechanical waves coming toward the first layer. The amplitude of the successive mechanical waves following the first wave of the mechanical waves temporarily increases upon the addition of the amplitude of the reflected mechanical waves in phase with the successive mechanical waves, which increases a magnitude of an impact of the successive mechanical waves following the first wave of the mechanical waves to the second layer. If the first layer is made of a material that has a lower hardness than that of the second layer, the reflected mechanical waves off the boundary between the first and the second layers from the first wave reverse the phase and merge with the successive mechanical waves coming toward the first layer in a way the amplitude of the successive mechanical waves decreases. It results in a reduction of the magnitude of the impact of the successive mechanical waves to the second layer.

To improve on efficiency of the protective headgear in reduction of an amplitude of mechanical waves of the blunt trauma to a human brain, a basic motif of the present invention for the protective headgear comprises an at-least four-layer shell having a first and outermost layer being softer than a second layer which is hardest and made undeformable, an innermost layer being softer than a human skull, and a third layer in between the innermost layer and the undeformable second layer. The third layer in between the innermost layer and the second layer is softer than the innermost layer and the second layer. All three layers except the second layer are to an extent compressible and depressibly deformable by an impact of the blunt trauma at an angle to a planar surface of each layer. Each layer is configured to have a measurable thickness and to be placed next to adjacent layers tightly without a gap.

The incident mechanical waves of the blunt trauma are carried in an incident mechanical three-dimensional columnar force centripetally hitting a single point of maximum impact which produces a maximum divergent, centrifugal reflection off a boundary of the protective headgear. The single point of the maximum impact on the boundary of the protective headgear becomes a single point of entry of a maximum transmitted mechanical three-dimensional force having transmitted mechanical waves toward the brain tissue. Transmission of the transmitted mechanical three-dimensional force having transmitted mechanical waves from the single point of entry focuses the transmitted mechanical three-dimensional force having transmitted mechanical waves on a geographically confined area of the brain tissue, in a way the geographically confined area of the brain tissue would receive a highest amplitude of the transmitted mechanical waves carried in the transmitted mechanical three-dimensional force. One of methods to reduce intensity of the tissue injury to the brain tissue upon the blunt trauma is to focus a reflected mechanical three-dimensional force having reflected mechanical waves out of phase with the incident mechanical waves on a destructive interference with the incident mechanical three-dimensional force having the incident mechanical waves. The incident mechanical three-dimensional force having the incident mechanical waves to the protective headgear in a hemispherical bowl shape can be understood as a liquid jet centripetally hitting a convex contour of the hemispherical bowl, which produces widespread radially scattered, centrifugal reflected liquid streams away from a longitudinal axis of the incident mechanical three-dimensional force. Although the phase of the reflected mechanical waves can be made reversed from a phase of the incident mechanical waves by a lower hardness of the first layer than that of the second layer of the protective headgear, an overall efficiency of the destructive interference with the incident mechanical three-dimensional force having the incident mechanical waves depends on a degree of coaxial convergence of the reflected mechanical three-dimensional force having the reflected mechanical waves with the incident mechanical three-dimensional force having the incident mechanical waves.

The reflected mechanical three-dimensional force having the reflected mechanical waves off the convex contour of the protective headgear can be made coaxially converge with the incident mechanical three-dimensional force having the incident mechanical waves by directing radial axes of reflection of the reflected mechanical three-dimensional force toward the longitudinal axis of the incident mechanical three-dimensional force. A polygon having protruded ridges encircling the polygon disposed on the convex contour of the protective headgear circumferentially surrounding the incident mechanical three-dimensional force to the protective headgear can be configured to produce directed reflections of the reflected mechanical three-dimensional force off the raised borders. A polygonal grid having a plurality of polygons in a configuration of a hemispherical polyhedron can be inserted in between the first layer and the second layer of the protective headgear. A protruding ridge between two adjacent polygons of the hemispherical polyhedron is configured to serve as a point of reflection of the incident mechanical three-dimensional force. A protruding ridge is provided in a configuration of a solid bar. Depending on a cross-sectional configuration of the protruding ridge, such as a rectangular bar configuration or an isosceles trapezoid configuration, angle of the reflection of the reflected mechanical three-dimensional force off the protruding ridge becomes controllable. In terms of the hardness, the polygonal grid is made less hard than the second layer but harder than the first layer. Difference in the hardness of the polygonal grid from that of the first layer induces a destructive interference with the incident mechanical waves by phase-reversed reflected mechanical waves reflecting off a boundary between the first layer and a plurality of the protruding ridges of the polygonal grid.

Intensity of an amplitude of the incident mechanical waves delivered to the brain tissue depends on a mass (weight) of a source generating the incident mechanical waves multiplied by a velocity of an impact from the source and a mass (weight) of a victim and a stopping distance of the impact by the victim colliding with the source: $KE=\frac{1}{2}\times mv^2$ where KE is kinetic energy before an impact, m is mass in kg and v is velocity in meter/second. Since the stopping distance of the impact by the victim is a relatively fixed value (a head does not fall off from a body) and the velocity of the impact from the source could be a relatively fixed value depending on a type of collision, the weight of both the source and victim for the most part would determine the amplitude of the incident mechanical waves from the impact. What this suggests is that an one-size-fits-all protective headgear is not proper for people having a similar size of head but with a range of different body weights. A person with a lighter body weight as a victim of an impact of a blunt trauma to a head will sustain a less powerful amplitude of incident mechanical waves of the impact than a person with a heavier weight. A person with a heavier weight as a victim of a blunt trauma to a head may not be protected well by a multi-layered protective headgear which is made to protect a person with a lighter weight. Since the collision between the source and the victim is a bidirectional process, one of methods to accommodate variable weights of people wearing the multi-layered protective headgear of a similar size is to vary thickness and density of inner layers directly covering the head of a person depending on a body weight of the person. A person with a heavier weight is protected better by a multi-layered protective headgear with thicker and/or denser inner layers.

SUMMARY OF THE INVENTION

In an effort to increase an efficiency of reduction of an intensity of a blunt trauma to a head wearing a protective headgear, the present invention provides a protective headgear having an at-least four-layer shell and a polygonal grid fixedly inserted in between a first and outermost layer and a second layer of the at-least four-layer shell. The at-least four-layer shell comprises the outermost layer being softer than the second layer which is hardest and made undeformable, an innermost layer being softer than a human skull, and a third layer between the innermost layer and the second layer. The third layer is softer than the innermost layer and the second layer, and is fixedly adhered to the innermost layer. All three layers except the second layer are to an extent compressible and depressibly deformable by an impact of the blunt trauma at an angle to a planar surface of each layer. The third layer and the innermost layer are provided in a range of thickness and density so as to accommodate a range of body weight of people wearing the protective headgear.

In one embodiment, the polygonal grid comprises a plurality of polygons in a configuration of a hemispherical polyhedron, and is made of a thermoplastic polymer such as polyvinyl chloride, thermoplastic polyurethanes, polybutadiene, or polyethylene. The thermoplastic polymer of the polygonal grid has a Rockwell R hardness value ranging from 70 to 140. The Rockwell R hardness value of the thermoplastic polymer of the polygonal grid is configured to be higher than that of the outermost layer but lower than that of the second layer. A plurality of the polygons adjoin each other along a border between two adjacent polygons, wherein the border between the two adjacent polygons of the hemispherical polyhedron is configured to be raised to form an outwardly protruding ridge which serves as a point of reflection of an incident mechanical three-dimensional force having incident mechanical waves. An lower base of the protruding ridge is fixedly adhered to an outer surface of the second layer, and an upper base and both sides are fixedly adhered to an inner wall of the outermost layer.

In one embodiment, the protruding ridge of the polygonal grid is provided as a solid longitudinal bar in a rectangular cross-sectional configuration whose sides intersect at 90° angles. A cross-sectional length of an upper base is equal to a cross-sectional length of an inner base. A first part of the incident mechanical three-dimensional force having the incident mechanical waves will be reflected off an edge of an upper base of a first protruding ridge as a first reflected mechanical three-dimensional force having first reflected mechanical waves. According to Huygens' principle, the reflected mechanical three-dimensional force having reflected mechanical waves spread spherically in a centrifugal direction away from the edge of the first protruding ridge. A second part of the incident mechanical three-dimensional force having the incident mechanical waves will be reflected off an edge of an upper base of a second protruding ridge facing the first protruding ridge as a second reflected mechanical three-dimensional force having second reflected mechanical waves. Similar to the first reflected mechanical force having the first reflected mechanical waves, the second reflected mechanical three-dimensional force having the second reflected mechanical waves spreads spherically off the edge of the second protruding ridge, merging in phase with the first reflected mechanical three-dimensional force having the first reflected mechanical waves. Since the first and second reflected mechanical waves are in phase with each other but out of phase with the incident mechanical waves based on a difference in hardness between the protruding ridge and the outermost layer, there is a temporary augmentation of the reflected reflected mechanical three-dimensional force having the reflected mechanical waves moving back to the incident mechanical three-dimensional force having the incident mechanical waves, thereby enhancing reduction of the incident mechanical three-dimensional force having the incident mechanical waves along a longitudinal axis of the incident mechanical three-dimensional force. A third part of the incident mechanical three-dimensional force having the incident mechanical waves will be reflected tangentially off a side of the first protruding ridge as a third reflected mechanical three-dimensional force having third reflected mechanical waves. A fourth part of the incident mechanical three-dimensional force having the incident mechanical waves will be reflected tangentially off a side of the second protruding ridge facing the first protruding ridge as a fourth reflected mechanical three-dimensional force having fourth reflected mechanical waves. Both the third and fourth reflected mechanical waves, which are in phase with each other but out of phase with the incident mechanical waves, spread spherically and merge coaxially with each other, thereby enhancing reduction of the incident mechanical three-dimensional force close to the outer surface of the second layer.

In other embodiment, the protruding ridge is provided in an isosceles trapezoid configuration on a cross section of the protruding ridge having a longer lower base, a shorter upper base, and a pair of sides of same length with each side connecting the lower base to the upper base. In addition to reflected mechanical three-dimensional force having reflected mechanical waves off edges of protruding ridges, a first part of an incident mechanical three-dimensional force having incident mechanical waves will be reflected tangentially off a side of a first protruding ridge as a first reflected mechanical three-dimensional force having first reflected mechanical waves. A second part of the incident mechanical three-dimensional force having the incident mechanical waves will be reflected tangentially off a side of a second protruding ridge facing the first protruding ridge as a second reflected mechanical three-dimensional force having second reflected mechanical waves. Since the side of the first protruding ridge is at an obtuse angle to a planar contour of the outer surface of the second layer, and the side of the second protruding ridge is at an obtuse angle in a mirror image to the obtuse angle of the side of the first protruding ridge, both the first and second reflected mechanical waves in phase with each other but out of phase with the incident mechanical waves merge with each other at an angle between each longitudinal axis of the first and second reflected mechanical waves, respectively. In this configuration, a maximum augmentation of the first and second reflected mechanical three-dimensional forces with the first and second reflected mechanical waves occurs a distance away from the outer surface of the second layer of the protective headgear. Angle of reflection of a reflected mechanical three-dimensional force having reflected mechanical waves off the protruding ridge becomes a controllable factor for efficiency of reduction of the incident three-dimensional mechanical force having the incident mechanical waves, depending on a cross-sectional base angle of the side of a protruding ridge in the isosceles trapezoid configuration. A range of the cross-sectional base angle of the isosceles trapezoid is provided for the protruding ridge of the present invention, so as to accommodate a range of body weight of a person wearing the protective headgear and an anticipated type of collision resulting in the blunt trauma to the person wearing the protective headgear.

In one embodiment, the outermost layer is provided in a hemispherical bowl shape, comprising an outer wall having a smooth contour and an inner wall having a plurality of planar tiles arranged in a criss-cross tiled configuration. Each planar tile of the inner wall of the outermost layer is fixedly adhered to the second layer. A boundary between two adjacent planar tiles of the inner wall of the outermost layer comprises a linear groove disposed in between two adjacent planar tiles. The linear groove is configured to fixedly mate with and adhere to the protruding ridge of the polygonal grid in a way that the polygonal grid is fixedly inserted in between the outermost layer and the second layer. The outermost layer is made of a polymer foam which is configured in a closed-cell structure to achieve a high ratio of indentation force deflection to density. Examples of the polymer foam include polyolefin foams, polyethylene foams, and flexible polyurethane foams. Ideally the closed-cell polymer foam for the outermost layer has a 25% indentation force deflection value of higher than 45 and a foam support factor of higher than 3.0. The outermost layer is configured to have a Rockwell R value ranging from 70 to 140.

In one embodiment, the second layer is made of a combination of hard polymers such as polycarbonate, ethylene propylene diene, fluropolymers, or styrene-butadiene-styrene block copolymer. The hard polymers of the second layer are made to have a Rockwell R value of higher than 140 so as to withstand a blunt impact without deformation of a planar surface of the second layer over a gravitational force up to 300 g±30 g (10% S.D.) and over a range of temperature from 0° F. to 175° F. without material failure. The second layer is configured in a hemispherical bowl shape to enclose the third layer. An inner surface of a circumferential rim of the second layer is configured to be reversibly adhered to a circumferential rim of the third layer.

In one embodiment, the third layer is made of a polymer foam in a flexible open-cell configuration so as to release a portion of transmitted mechanical waves to an ambient air. Examples of the polymer foam include open-cell polyester-urethane foams, open-cell polyurethane foams, open-cell polyolefin foams, and open-cell polyethylene foams. The polymer foam for the third layer has a 25% indentation force deflection value of higher than 45 and a foam support factor of between 1.5 and 3.0. The third layer is configured to have a hardness of a Shore D scale value of at least 10 below the Shore D scale value of the innermost layer. The third layer is configured in a similar hemispherical bowl shape to that of the second layer and is configured to be tightly enclosed in a hemispherical space provided by the second layer and the innermost layer. An inner surface of the third layer is fixedly adhered to an outer surface of the innermost layer. The circumferential rim of the third layer is configured to be reversibly adhered to the inner surface of the circumferential rim of the second layer, leaving the rest of surface of the third layer unattached so as to assist movement of air in and out of open cells of the third layer. The third layer of the present invention is provided over a range of cross-sectional thickness and density so as to accommodate a range of body weight of people wearing the protective headgear.

In one embodiment, the innermost layer is made of a closed-cell polymer foam to achieve a high ratio of indentation force deflection to density. Examples of the polymer foam include polyolefin foams, polyethylene foams, and flexible polyurethane foams. Ideally the polymer foam for the innermost layer has a 25% indentation force deflection value of higher than 45 and a foam support factor of higher than 3.0. The innermost layer is configured to have a hardness of a Shore D scale value of between 65 and 90, as a Shore D scale value of bone is known to be just below 100. The innermost layer in a similar hemispherical bowl, shape is configured to enclosably cover an area of the human head comprising a part of frontal, an entire parietal, a majority of temporal and occipital regions. The outer surface of the innermost layer is fixedly adhered to the inner surface of the third layer. The innermost layer of the present invention is provided over a range of cross-sectional thickness and density so as to accommodate a range of body weight of people wearing the protective headgear.

BRIEF DESCRIPTION OF THE DRAWINGS

FIG. 4A illustrates a schematic example of the inner layer comprising the third layer and the innermost layer; FIG. 4B shows a schematic example of the second layer; FIG. 4C shows a schematic example of the polygonal grid; FIG. 4D shows a schematic example of the outermost layer.

DETAILED DESCRIPTION OF THE DRAWINGS

As described below, the present invention provides a mechanical-waves attenuating protective headgear. It is to be understood that the descriptions are solely for the purposes of illustrating the present invention, and should not be understood in any way as restrictive or limited. Embodiments of the present invention are preferably depicted with reference to FIGS. 1 to 9, however, such reference is not intended to limit the present invention in any manner. The drawings do not represent actual dimension of devices, but illustrate the principles of the present invention.

Figure 1:
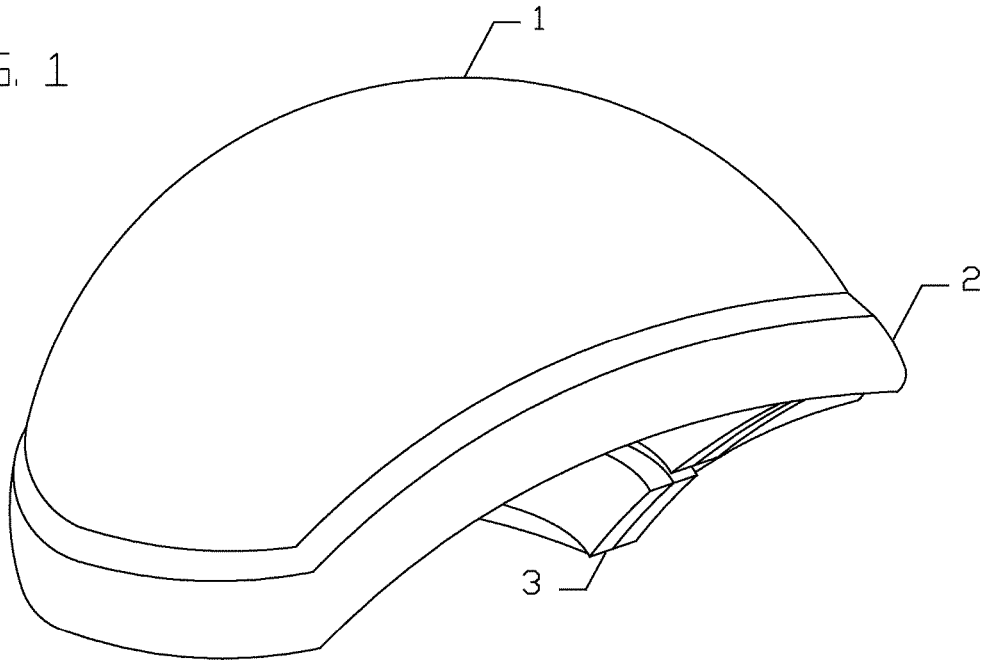
FIG. 1 shows a schematic presentation of a mechanical-waves attenuating protective headgear.

FIG. 1 shows a schematic presentation of a mechanical-waves attenuating protective headgear which comprises a dome portion 1 covering the majority of a head including frontal, parietal, sphenoid, occipital and temporal regions of a human head, a lower circumferential rim 2 covering a portion of zygomatic arch and mastoid protuberance of the human head, and an inner layer 3. The dome portion is provided in a hemispherical bowl shape. The inner layer 3 is configured to be reversibly attachable to an inner surface of the dome 1.

Figure 2A:
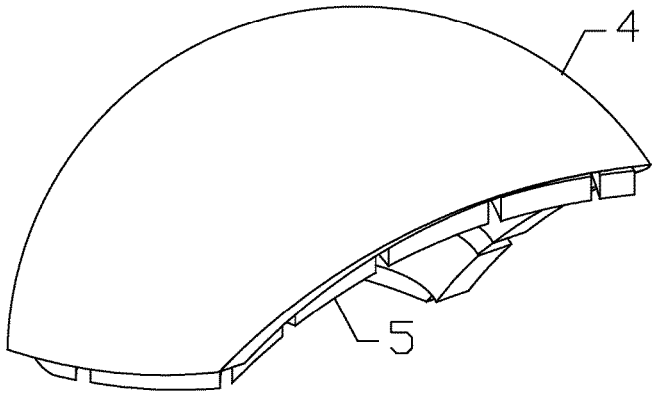
FIG. 2A represents a schematic view of an outermost layer.
Figure 2B:
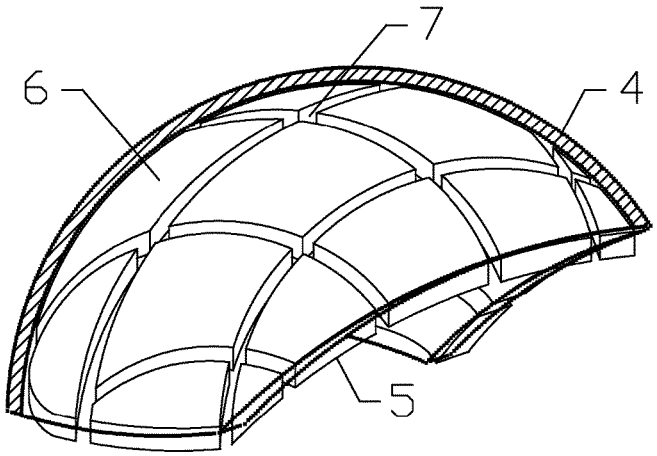
FIG. 2B shows a schematic see-through view of the outermost layer.
Figure 2C:
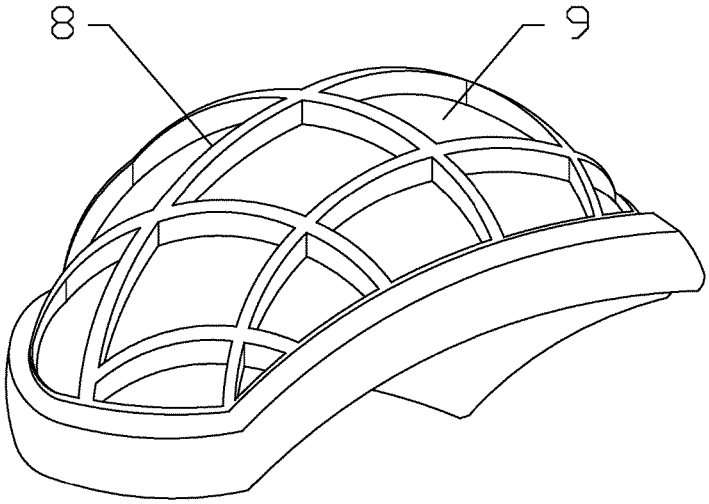
FIG. 2C shows a schematic view of a polygonal grid.

FIG. 2A represents a schematic view of an outermost layer comprising an outer wall 4 and an inner wall 5. FIG. 2B shows a schematic see-through view of the inner wall 5 comprising a plurality of planar tiles 6 arranged in a criss-cross configuration. In between two adjacent planar tiles 6 of the inner wall 5, a linear groove 7 is provided. FIG. 2C shows a polygonal grid comprising a plurality of polygons 9 in a configuration of a hemispherical polyhedron. A plurality of the polygons adjoin each other along a border between two adjacent polygons, wherein the border between the two adjacent polygons of the hemispherical polyhedron is configured to be raised to form an outwardly protruding ridge 8. Each planar tile 6 of the inner wall 5 of the outermost layer shown in FIG. 2B is configured to fill up a space of each polygon 9. The protruding ridge 8 of FIG. 2C is configured to fixedly mate with the linear groove 7 of the inner wall 5 of FIG. 2B. The outermost layer comprise a closed-cell polymer foam having a measurable thickness ranging from 0.2 inches to 2.0 inches, which is configured to be compressible and depressibly deformable by an impact of a blunt trauma at an angle to a planar surface of the outermost layer. The closed-cell polymer foam of the outermost layer has a 25% indentation force deflection value of higher than 45, a foam support factor of higher than 3.0, and a Rockwell R value ranging from 70 to 140.

Figure 3A:
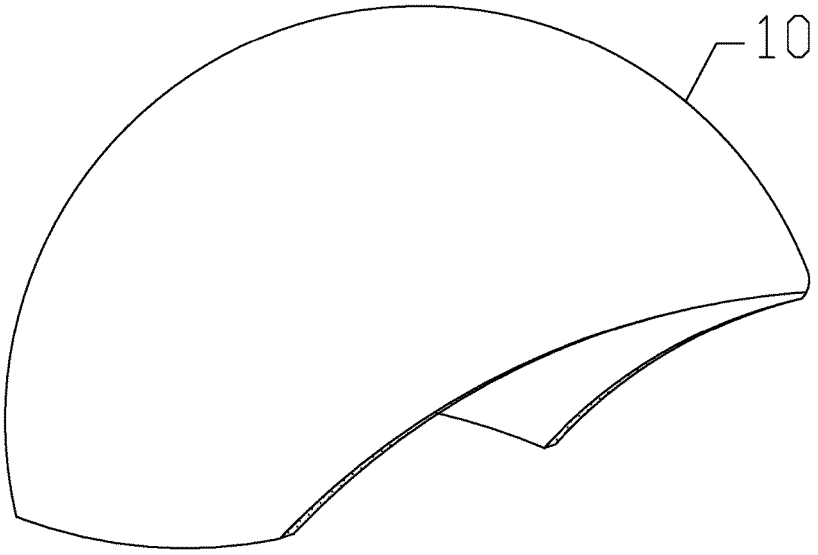
FIG. 3A illustrates a schematic view of a second layer.
Figure 4A:
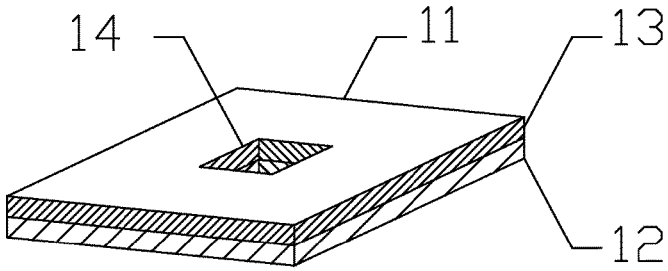
FIGS. 4A-4D depict schematic exploded views of an at-least four-layered shell of the mechanical-waves attenuating protective headgear.
Figure 4B:
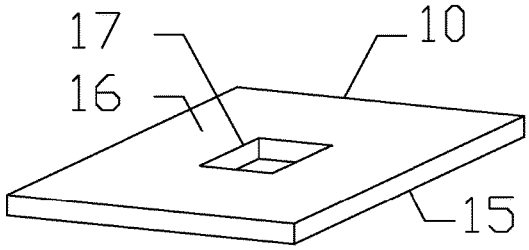

FIG. 3A shows a schematic view of the second layer 10 in a hemispherical bowl shape. Referring to FIG. 4B, an outer surface 15 of the second layer 10 is adherently enclosed by a plurality of the planar tiles 6 of the inner wall 5 of FIG. 2B, and fixedly attached to the protruding ridge 8 of the polygonal grid of FIG. 2C. The second layer comprises a solid plate in the hemispherical bowl shape having a measurable thickness ranging from 0.1 inches to 1.0 inches, which is made of hard polymers having a Rockwell R value of higher than 140 and configured to be undeformable to the impact of the blunt trauma at an angle to a planar surface of the second layer over a gravitational force of up to 300 g±30 g (10% S.D.) and over a range of temperature from 0° F. to 175° F. without material failure.

Figure 3B:
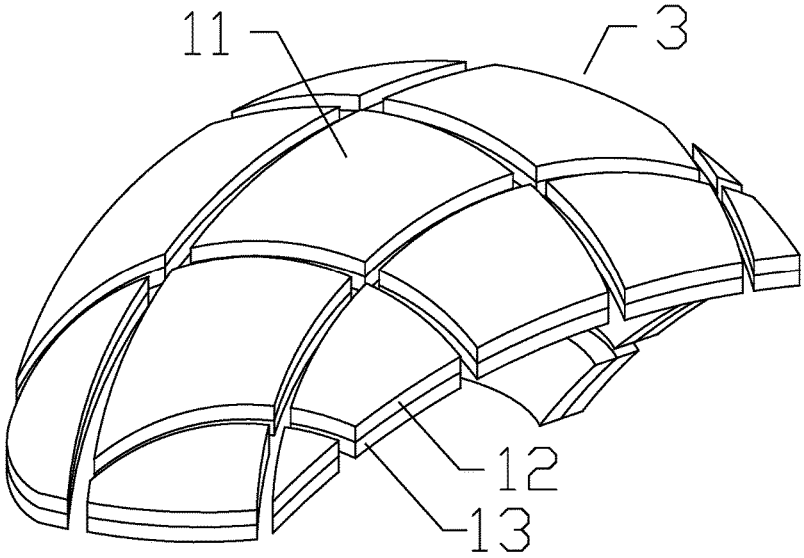
FIG. 3B shows a schematic example of an inner layer comprising a third layer adhered to an innermost layer.

FIG. 3B shows a schematic view of the inner layer 3 having a plurality of planar tiles 11 comprising a third layer 12 tightly adherent to an innermost layer 13. An outer circumferential portion of the inner layer 3 is configured to be reversibly attachable to a portion of the lower circumferential rim 2 of FIG. 1. The third layer 12 comprises an open-cell polymer foam having a measurable thickness ranging from 0.2 inches to 2.0 inches, which is configured to be compressible and depressibly deformable by the impact of the blunt trauma at an angle to a planar surface of the third layer. The open-cell polymer foam of the third layer has a 25% indentation force deflection value of higher than 45, a foam support factor of between 1.5 and 3.0, and a hardness of a Shore D scale value of at least 10 below the Shore D scale value of the innermost layer 13. The innermost layer comprises a closed-cell polymer foam having a measurable thickness ranging from 0.2 inches to 2.0 inches, which is configured to be compressible and depressibly deformable by the impact of the blunt trauma at an angle to a planar surface of the innermost layer. The closed-cell polymer foam of the innermost layer has a 25% indentation force deflection value of higher than 45, a foam support factor of higher than 3.0, and a hardness of a Shore D scale value of between 65 and 90. The inner surface 16 is configured to enclosably cover an area of the human head comprising a part of the frontal, the entire parietal, a majority of the temporal region and a majority of the occipital region.

Figure 4C:
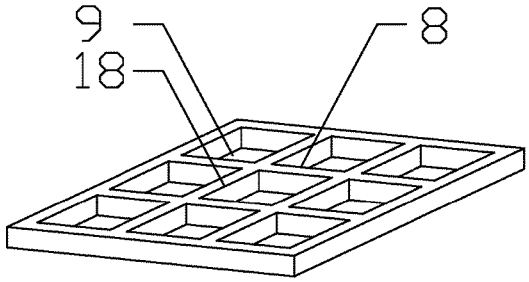
Figure 4D:
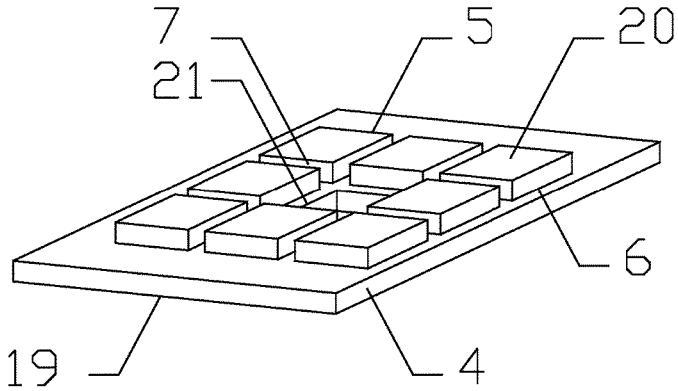

FIGS. 4A-4D depict schematic exploded views of an at-least four-layered shell of the mechanical-waves attenuating protective headgear. Shown in FIG. 4A, the planar tile 11 comprises the third layer 12 tightly adherent to the innermost layer 13. A fenestration 14 can be provided for ventilation through the planar tile 11. FIG. 4B shows the second layer 10 having the outer surface 15 and an inner surface 16. A fenestration 17 can be provided for ventilation through the second layer 10, corresponding to the fenestration 14 of the planar tile 11 of the inner layer of FIG. 4A. FIG. 4C shows the polygonal grid comprising a plurality of the polygons 9, with each polygon surrounded by the protruding ridge 8. A fenestration portion 18 can be provided, corresponding to the fenestration 14 of the planar tile 11 of the inner layer of FIG. 4A and the fenestration 17 of the second layer of FIG. 4B. FIG. 4D shows the outermost layer comprising the outer wall 4 and the inner wall 5. An outer surface 19 of the outer wall is configured as a smooth convex hemispherical surface. An inner surface 20 of the planar tile 6 is configured to tightly adhere to the outer surface 15 of the second layer 10. The linear groove 7 disposed in between two adjacent planar tiles 6 is configured to fixedly mate with the protruding ridge 8 of FIG. 4C. A fenestration 21 can be provided for ventilation through the outermost layer, corresponding to the fenestration 14 of the planar tile 11 of the inner layer of FIG. 4A, the fenestration 17 of the second layer of FIG. 4B and the fenestration portion 18 of the polygonal grid of FIG. 4C.

Figure 5:
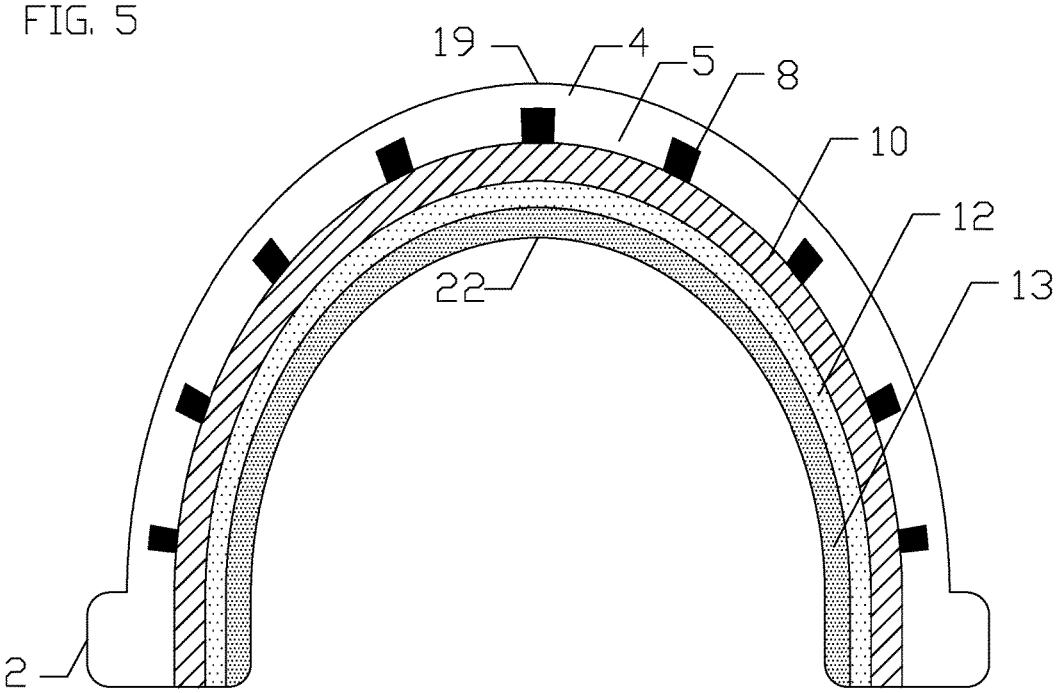
FIG. 5 illustrates a schematic coronal view of stacked-up layers of the at-least four-layered shell of the mechanical-waves attenuating protective headgear, having the polygonal grid inserted in between the outermost layer and the second layer.

FIG. 5 illustrates a schematic coronal view of stacked-up layers of the at-least four-layered shell of the mechanical-waves attenuating protective headgear. The outermost layer having the inner wall 5 and the outer wall 4 covered by the outer surface 19 in a configuration of the smooth convex hemispherical surface adheres tightly to the second layer 10 so as to facilitate reflection of incident mechanical waves off a boundary between the inner surface 20 of the outermost layer shown in FIG. 4D and the outer surface 15 of the second layer 10 shown in FIG. 4B. In between the outermost layer 4-5 and the second layer 10, the polygonal grid with protruding ridges 8 is fixedly inserted. The inner surface 16 of the second layer 10 shown in FIG. 4B is tightly placed in contact with an outer surface of the third layer 12. There is no adhesion between the second layer 10 and the third layer 11 except a portion of the lower circumferential rim 2 which is configured to be reversibly attachable to an outer circumferential portion of the third layer 12, which is to facilitate air movement in and out of open cells of the open-cell polymer foam of the third layer 12. The third layer 12 is adherently attached to the innermost layer 13 having an inner surface 22. The inner surface 22 is configured in a hemispherical bowl shape so as to accommodate a dome shaped human head.

Figure 6A:
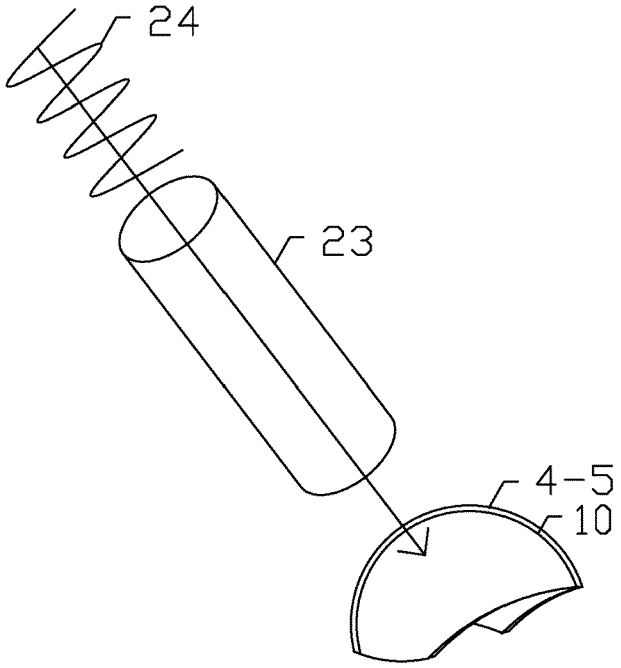
FIG. 6A illustrates a schematic depiction of a blunt trauma with an incident mechanical three-dimensional force having incident mechanical waves hitting the outermost layer and the second layer of the mechanical-waves attenuating protective headgear without the polygonal grid in between the outermost layer and the second layer.
Figure 6B:
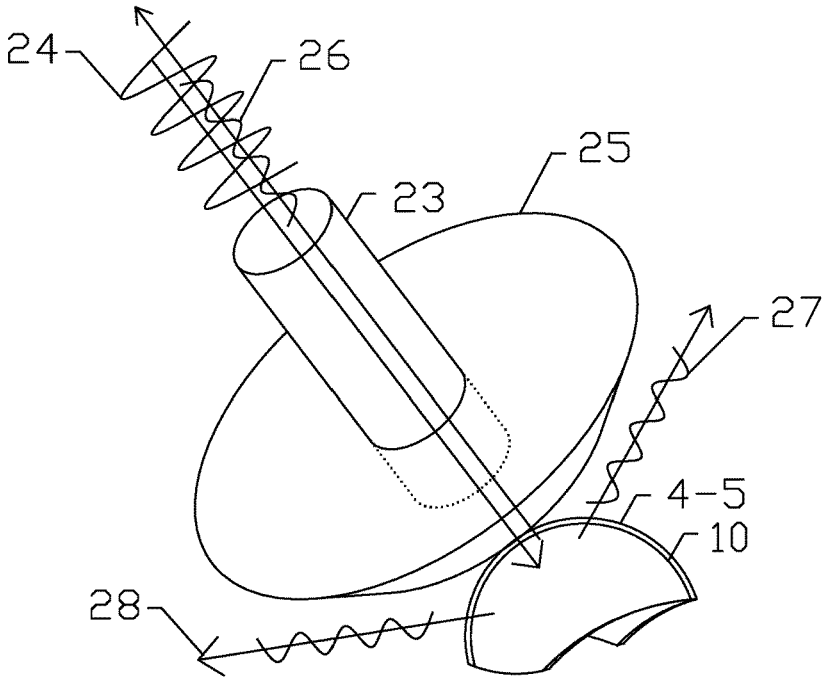
FIG. 6B shows a reflected mechanical three-dimensional force having reflected mechanical waves radially reflecting off the outermost layer and the second layer.

FIG. 6A illustrates a schematic depiction of a blunt trauma with an incident mechanical three-dimensional force 23 having incident mechanical waves 24 centripetally hitting the outermost layer 4-5 and the second layer 10 of the mechanical-waves attenuating protective headgear without the polygonal grid in between the outermost layer 4-5 and the second layer 10. Shown in FIG. 6B, a part of the incident mechanical three-dimensional force 23 having the incident mechanical waves 24 is reflecting off a boundary between the outermost layer 4-5 and the second layer 10 as a reflected mechanical three-dimensional force 25 having reflected mechanical waves 26-28. The reflected mechanical waves 26-28 are out of phase with the incident mechanical waves 24 since hardness of the outermost layer 4-5 is less than that of the second layer 10, thereby reducing an amplitude of the incident mechanical three-dimensional force 23 having the incident mechanical waves 24. Around a center of a site of the blunt trauma by the incident mechanical three-dimensional force 23 having the incident mechanical waves 24, a part of the reflected mechanical three-dimensional force 25 having the reflected mechanical waves 26 coaxially spreads back along a longitudinal axis of the incident mechanical three-dimensional force 23 having the incident mechanical waves 24. Due to a spherical contour of the outermost layer 4-5 and the second layer 10 of the mechanical-waves attenuating protective headgear, other parts of the reflected mechanical three-dimensional force 25 reflecting off outside the center of the site of the blunt trauma spread in a widespread radially scattered pattern, producing the reflected mechanical waves 27 and 28. Consequently a force field of the reflected mechanical three-dimensional force 25 is more radially spread than coaxially concentrated, thus diminishing efficiency of the reduction of the incident mechanical three-dimensional force 23 by the reflected mechanical three-dimensional force 25.

Figure 7A:
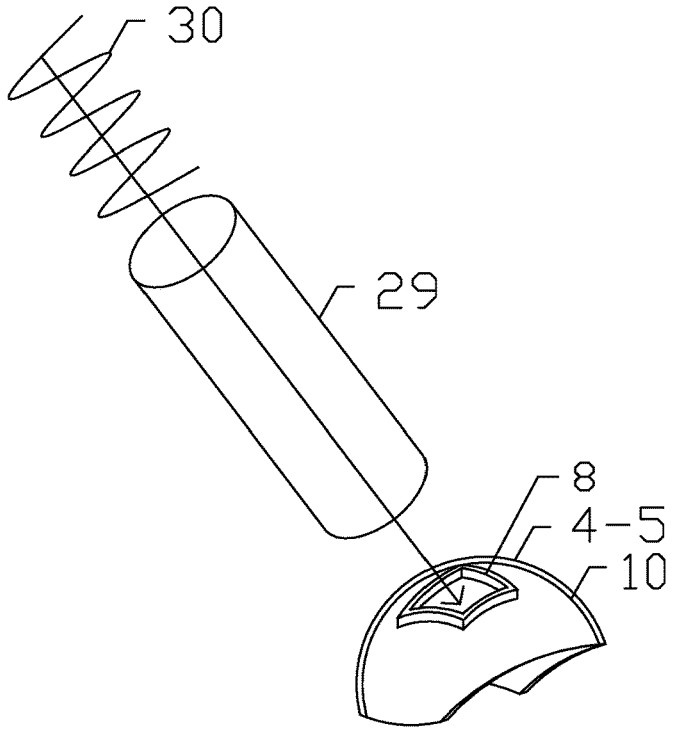
FIG. 7A shows a schematic illustration of a blunt trauma with an incident mechanical three-dimensional force having incident mechanical waves hitting the outermost layer and the second layer of the mechanical-waves attenuating protective headgear with the polygonal grid in between the outermost layer and the second layer.
Figure 7B:
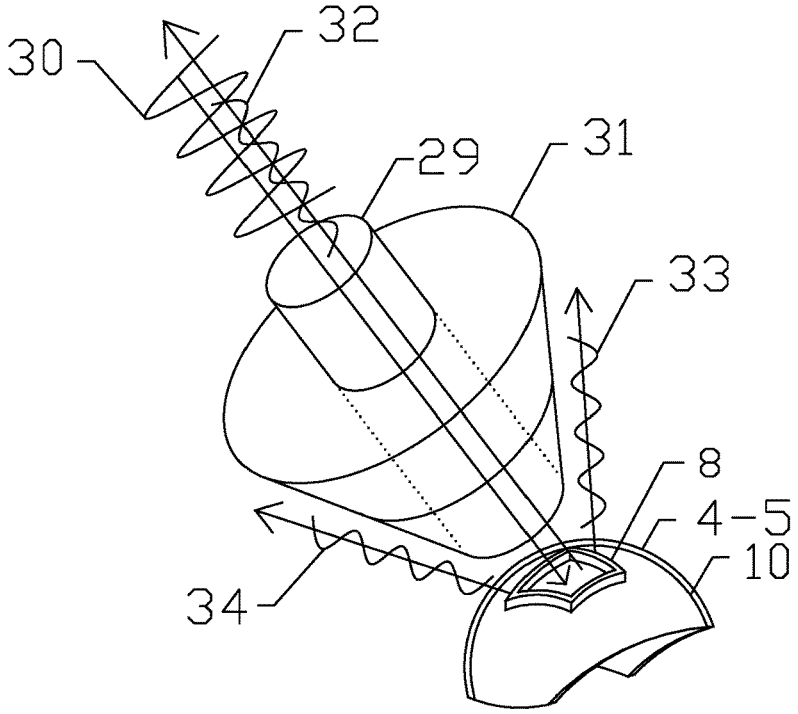
FIG. 7B shows a reflected mechanical three-dimensional force having reflected mechanical waves coaxially converging with the incident mechanical three-dimensional force having the incident mechanical waves after reflecting off the outermost layer and the second layer.

FIG. 7A shows a schematic illustration of a blunt trauma with an incident mechanical three-dimensional force 29 having incident mechanical waves 30 centripetally hitting the outermost layer 4-5 and the second layer 10 of the mechanical-waves attenuating protective headgear with the polygonal grid having protruding ridges 8 in between the outermost layer 4-5 and the second layer 10. Shown in FIG. 7B, a part of the incident mechanical three-dimensional force 29 having the incident mechanical waves 30 is reflecting off a boundary between the outermost layer 4-5 and the second layer 10 and the protruding ridges 8 of the polygonal grid as a reflected mechanical three-dimensional force 31 having reflected mechanical waves 32-34. The reflected mechanical waves 32 is out of phase with the incident mechanical waves 30 since the hardness of the outermost layer 4-5 is less than that of the second layer 10. Similarly, the reflected mechanical waves 33-34 reflecting off the protruding ridges 8 are out of phase with the incident mechanical waves 30 since the hardness of the protruding ridges 8 is higher than that of the outermost layer 4-5. These phase-reversed reflected mechanical waves 32-34 merge with the incident mechanical waves 30, thereby reducing an amplitude of the incident mechanical three-dimensional force 29 having the incident mechanical waves 30. Similar to a sequence of events shown in FIG. 6A-6B, around a polygonal center of a site of the blunt trauma by the incident mechanical three-dimensional force 29 having the incident mechanical waves 30, a part of the reflected mechanical three-dimensional force 31 having the reflected mechanical waves 32 coaxially spreads back along a longitudinal axis of the incident mechanical three-dimensional force 29 having the incident mechanical waves 30. Other parts of the reflected mechanical three-dimensional force 31 having the reflected mechanical waves 33-34 reflecting off edges of the protruding ridges 8 spread spherically in a centrifugal direction away from the edges of the protruding ridges 8. The reflected mechanical waves 33-34 reflecting off the edges of the protruding ridges 8 spherically cluster around the protruding ridges 8 of a polygon of the polygonal grid, while spreading in the centrifugal direction. Combination of the reflected mechanical waves 33-34 with the reflected mechanical waves 32 produces a narrow, coaxially converging field of the reflected mechanical three-dimensional force 31. The coaxial convergence of the reflected mechanical three-dimensional force 31 having the reflected mechanical waves 32-34 with the incident mechanical three-dimensional force 29 having the incident mechanical waves 30 enhances the efficiency of reduction of the incident mechanical three-dimensional force 29 having the incident mechanical waves 30.

Figure 8A:
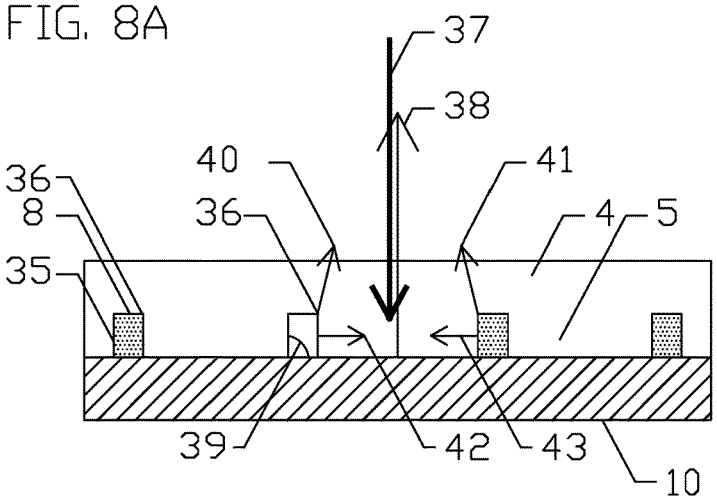
FIGS. 8A-8C show schematic examples of a cross-sectional configuration of protruding ridges of the polygonal grid and points of reflection of incident mechanical three-dimensional force.

FIG. 8A shows a schematic example of a rectangular cross-sectional configuration of a protruding ridge 8 having a base angle 39 of 90°, a side 35 and an edge 36 as an example, embedded between the outermost layer 4-5 and the second layer 10. A first part of an incident mechanical three-dimensional force 37 to a boundary between the outermost layer 4-5 and the second layer 10 is reflected off coaxially as a reflected mechanical three-dimensional force 38. A second part of the incident mechanical three-dimensional force 37 to the edge 36 is reflected tangentially off as a reflected mechanical three-dimensional force 40, heading toward a longitudinal axis of the incident mechanical three-dimensional force 37. A third part of the incident mechanical three-dimensional force 37 to the side is reflected off as a reflected mechanical three-dimensional force 42 at a right angle to the side. If a pair of the protruding ridges of a polygon are arranged in a mirror image to each other, the reflected mechanical three-dimensional force 40 is mirrored as a reflected mechanical three-dimensional force 41; the reflected mechanical three-dimensional force 42 is mirrored as a reflected mechanical three-dimensional force 43.

Figure 8B:
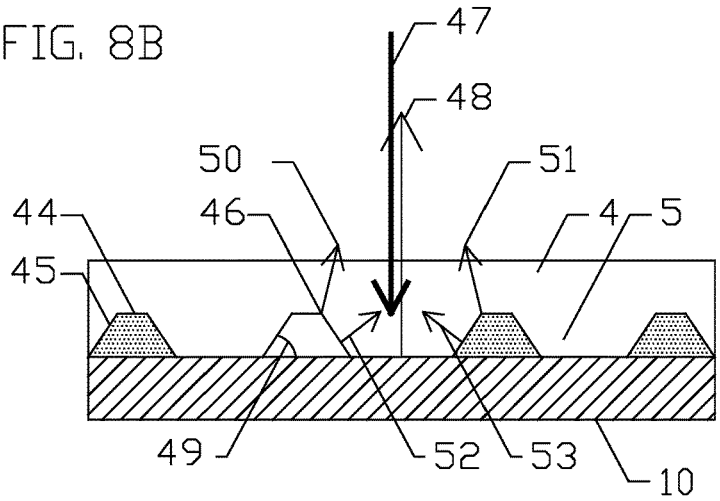

FIG. 8B shows a schematic example of an isosceles trapezoid cross-sectional configuration of a protruding ridge 44 having an acute base angle 49, an obtuse side 45 and an edge 46 as an example, embedded between the outermost layer 4-5 and the second layer 10. A first part of an incident mechanical three-dimensional force 47 to a boundary between the outermost layer 4-5 and the second layer 10 is reflected off coaxially as a reflected mechanical three-dimensional force 48. A second part of the incident mechanical three-dimensional force 47 to the edge 46 is reflected tangentially off as a reflected mechanical three-dimensional force 50, heading toward a longitudinal axis of the incident mechanical three-dimensional force 47. A third part of the incident mechanical three-dimensional force 47 to the obtuse side is reflected off as a reflected mechanical three-dimensional force 42 at a right angle to the obtuse side, directing the reflected mechanical three-dimensional force 52 toward the longitudinal axis of the incident mechanical three-dimensional force 47 away from the boundary between the outermost layer 4-5 and the second layer 10. If a pair of the protruding ridges 45 of a polygon are arranged in a mirror image to each other, the reflected mechanical three-dimensional force 50 is mirrored as a reflected mechanical three-dimensional force 51; the reflected mechanical three-dimensional force 52 is mirrored as a reflected mechanical three-dimensional force 53.

Figure 8C:
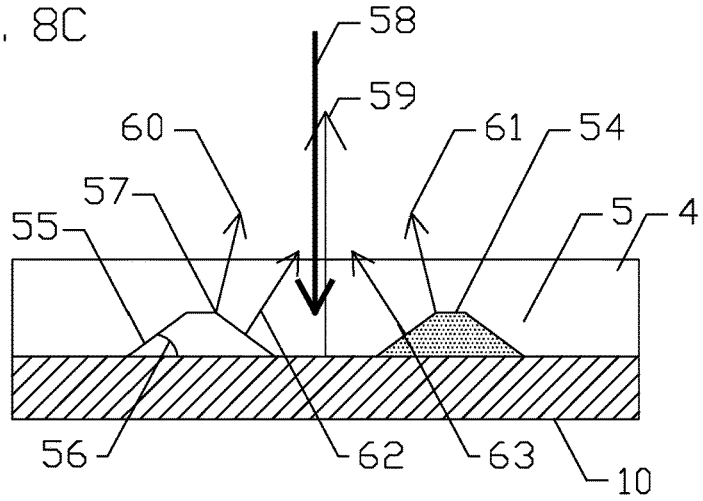

FIG. 8C shows a schematic example of an isosceles trapezoid cross-sectional configuration of a protruding ridge 54 having an acute base angle 56, an obtuse side 55 and an edge 57 as an example, embedded between the outermost layer 4-5 and the second layer 10. The acute base angle 56 of FIG. 8C is more acute than the acute base angle 49 shown in FIG. 8B. A first part of an incident mechanical three-dimensional force 58 to a boundary between the outermost layer 4-5 and the second layer 10 is reflected off coaxially as a reflected mechanical three-dimensional force 59. A second part of the incident mechanical three-dimensional force 58 to the edge 57 is reflected tangentially off as a reflected mechanical three-dimensional force 60, heading toward a longitudinal axis of the incident mechanical three-dimensional force 58. A third part of the incident mechanical three-dimensional force 58 to the obtuse side is reflected off as a reflected mechanical three-dimensional force 62 at a right angle to the obtuse side, directing the reflected mechanical three-dimensional force 62 toward the longitudinal axis of the incident mechanical three-dimensional force 58 further away from the boundary between the outermost layer 4-5 and the second layer 10. If a pair of the protruding ridges 54 of a polygon are arranged in a mirror image to each other, the reflected mechanical three-dimensional force 60 is mirrored as a reflected mechanical three-dimensional force 61; the reflected mechanical three-dimensional force 62 is mirrored as a reflected mechanical three-dimensional force 63.

Figure 9A:
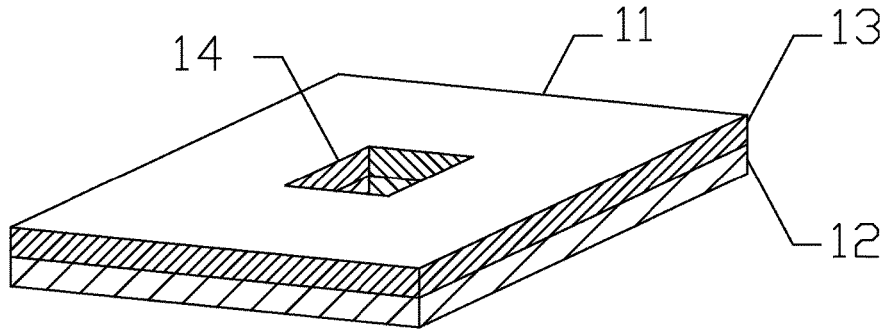
FIGS. 9A-9C show schematic examples of variable thickness and density of the third layer and the innermost layer.
Figure 9B:
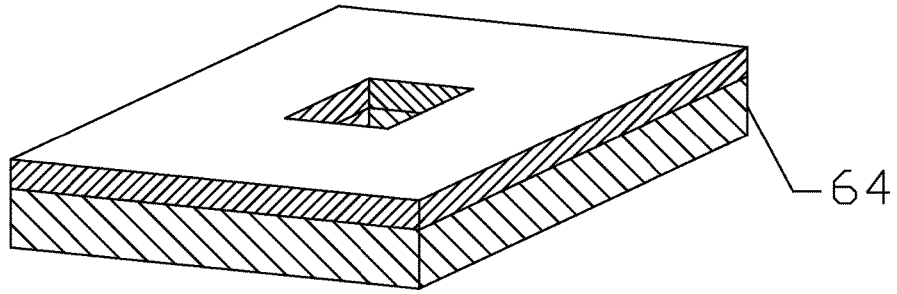
Figure 9C:
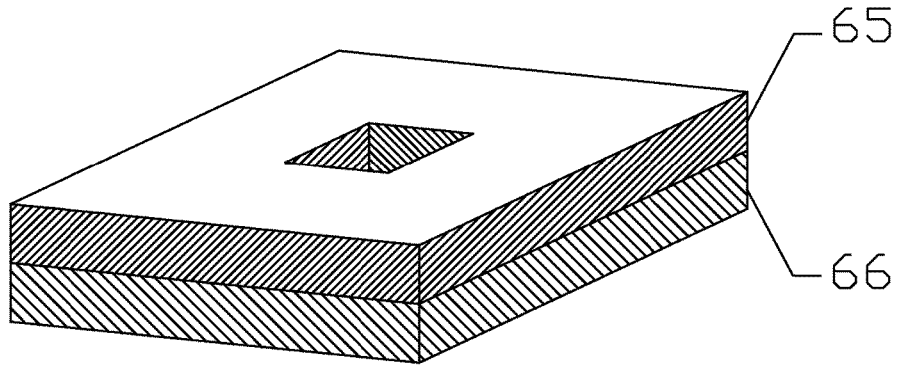

FIG. 9A represents a schematic example of a piece of the third layer 12 and the innermost layer 13 in a configuration of a planar tile 11 having a baseline thickness and density. FIG. 9B shows a schematic example of a thicker third layer 64 than the third layer 12 of FIG. 9A. FIG. 9C illustrates a schematic example of a thicker and denser third layer 66 and a thicker and denser innermost layer 65 than the third layer 12 and the innermost layer 13 of FIG. 9A, respectively.

It is to be understood that the aforementioned description of the apparatus is simple illustrative embodiments of the principles of the present invention. Various modifications and variations of the description of the present invention are expected to occur to those skilled in the art without departing from the spirit and scope of the present invention. Therefore the present invention is to be defined not by the aforementioned description but instead by the spirit and scope of the following claims.

What is claimed is:

1. A mechanical-waves attenuating protective headgear, comprising:

an at-least four-layer shell comprising a polygonal grid fixedly inserted in between an outermost layer and a second layer, and a third layer fixedly adhered to an innermost layer;

the polygonal grid, provided as a plurality of polygons of a thermoplastic polymer in a configuration of hemispherical polyhedron, wherein the polygonal grid is configured to have a hardness value higher than that of the outermost layer but lower than that of the second layer;

the outermost layer, provided as a closed-cell polymer foam in a configuration of hemispherical bowl shape, wherein an inner wall of the outermost layer is configured to fixedly adhere to the polygonal grid, and wherein the outermost layer is configured to have a hardness value less than that of the second layer;

the second layer, provided as a solid polymer plate in a configuration of hemispherical bowl shape, wherein an outer surface of the second layer is configured to fixedly adhere to the polygonal grid, and wherein the second layer is configured to have a highest hardness value of all layers of the at-least four-layer shell;

the third layer, provided as an open-cell polymer foam in a configuration of hemispherical bowl shape, wherein the third layer is configured to reversibly adhere to an inner surface of the second layer disposed thereof at a circumferential rim of the at-least four-layered shell, and wherein the third layer is configured to have a lower hardness value than that of the innermost layer; and the innermost layer, provided as a closed-cell polymer foam in a configuration of hemispherical bowl shape, wherein the innermost layer is configured to have a lower hardness value than that of human skull bone.

2. The mechanical-waves attenuating protective headgear according to claim 1, further comprising:

a boundary between two adjacent polygons of the polygonal grid comprises a protruding ridge disposed in between the two adjacent polygons, wherein the protruding ridge is provided in a solid longitudinal bar configuration.

3. The mechanical-waves attenuating protective headgear according to claim 2, wherein the solid longitudinal bar configuration of the protruding ridge includes a cross-sectional configuration of an isosceles trapezoid having a longer lower base, a shorter upper base, and a pair of sides of same length with each side connecting the lower base to the upper base.

4. The mechanical-waves attenuating protective headgear according to claim 1, further comprising:

the inner wall of the outermost layer, provided in a criss-cross tiled configuration having a plurality of closed-cell polymer foam tiles, wherein a boundary between two adjacent closed-cell polymer foam tiles of the outermost layer comprises a linear groove disposed in between the two adjacent closed-cell polymer foam tiles, and wherein the linear groove is configured to fixedly mate with the protruding ridge of the polygonal grid.

5. The mechanical-waves attenuating protective headgear according to claim 1, further comprising:

the third layer, provided over a range of thickness and density of the third layer so as to accommodate a body weight of a person wearing the mechanical-waves attenuating protective headgear, wherein an inner surface of the third layer is fixedly adhered to an outer surface of the innermost layer.

6. The mechanical-waves attenuating protective headgear according to claim 1, further comprising:

the innermost layer, provided over a range of thickness and density of the innermost layer so as to accommodate the body weight of the person wearing the mechanical-waves attenuating protective headgear, wherein the outer surface of the innermost layer is fixedly adhered to the inner surface of the third layer.

7. The mechanical-waves attenuating protective headgear according to claim 1, wherein the thermoplastic polymer of the polygonal grid has a Rockwell R hardness value ranging from 70 to 140.

8. The mechanical-waves attenuating protective headgear according to claim 1, wherein the closed-cell polymer foam of the outermost layer has a 25% indentation force deflection value of higher than 45, a foam support factor of higher than 3.0, and a Rockwell R hardness value ranging from 70 to 140.

9. The mechanical-waves attenuating protective headgear according to claim 1, wherein the solid polymer plate of the second layer has a Rockwell R hardness value of higher than 140.

10. The mechanical-waves attenuating protective headgear according to claim 1, wherein the open-cell polymer foam of the third layer has a 25% indentation force deflection value of higher than 45, a foam support factor of between 1.5 and 3.0, and a Shore D scale hardness value of at least 10 below a Shore D scale hardness value of the innermost layer.

11. The mechanical-waves attenuating protective headgear according to claim 1, wherein the closed-cell polymer foam of the innermost layer has a 25% indentation force deflection value of higher than 45, a foam support factor of higher than 3.0, and the Shore D scale hardness value of between 65 and 90.

12. The mechanical-waves attenuating protective headgear according to claim 3, further comprising:

the protruding ridge of the polygonal grid, wherein the protruding ridge is configured to be fixedly inserted in the linear groove of the outermost layer, and wherein a lower base of the protruding ridge of the polygonal grid is configured to be fixedly attached to the outer surface of the second layer.

13. The mechanical-waves attenuating protective headgear according to claim 3, further comprising:

the protruding ridge in the cross-sectional configuration of the isosceles trapezoid is provided over a range of a cross-sectional base angle of the isosceles trapezoid.

14. The mechanical-waves attenuating protective headgear according to claim 4, wherein the closed-cell polymer foam tiles of the inner wall of the outermost layer are fixedly adhered to the outer surface of the second layer.

* * * * *